US007332863B2

(12) United States Patent
Kwon

(10) Patent No.: US 7,332,863 B2
(45) Date of Patent: Feb. 19, 2008

(54) PLASMA DISPLAY PANEL (PDP)

(75) Inventor: Seung-Uk Kwon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 274 days.

(21) Appl. No.: 11/254,745

(22) Filed: Oct. 21, 2005

(65) Prior Publication Data

US 2006/0091803 A1 May 4, 2006

(30) Foreign Application Priority Data

Nov. 4, 2004 (KR) ..... 10-2004-0089228

(51) Int. Cl.
*H01J 17/49* (2006.01)

(52) U.S. Cl. ..... 313/582; 313/584; 313/586

(58) Field of Classification Search ..... 313/582–584, 313/586–587

See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| KR | 10-0196408 | 2/1999 |

*Primary Examiner*—Vip Patel
(74) *Attorney, Agent, or Firm*—Robert E. Bushnell, Esq.

(57) ABSTRACT

A Plasma Display Panel (PDP) includes: an upper substrate; a lower substrate facing the upper substrate; upper barrier ribs disposed between the upper and lower substrates to define a plurality of discharge cells together with the upper substrate; discharge electrodes adapted to generate a discharge in the plurality of discharge cells; lower barrier ribs formed between the upper barrier rib and lower substrate along a row of the plurality of discharge cells to define a plurality of flow paths by which the discharge cells communicate with each other; a phosphor layer applied at the same level as the lower barrier ribs; and a discharge gas contained within the plurality of discharge cells. Flow resistance is reduced when an impure gas is exhausted and when the discharge gas is injected into the panel, and the product yield and quality of the display are improved, and light emission efficiency is improved and degradation of the phosphor material is avoided.

8 Claims, 7 Drawing Sheets

PLASMA DISPLAY PANEL (PDP)

CLAIM OF PRIORITY

This application makes reference to, incorporates the same herein, and claims all benefits accruing under 35 U.S.C. §119 from an application for PLASMA DISPLAY PANEL earlier filled in the Korean Intellectual Property Office on 4 Nov. 2004 and there duly assigned Ser. No. 10-2004-0089228.

BACKGROUND OF THE INVENTION

1. Field of the Invention

The present invention relates to a Plasma Display Panel (PDP) displaying images using a gas discharge phenomenon.

2. Description of the Related Art

Plasma Display Panels (PDPs) are flat panel displays that are considered to be next generation flat panel displays due to their wide screens, and excellent display characteristics such as high image quality, ultra-thin thickness, and light weight. In addition, it is easy to fabricate a PDP and to enlarge the panel.

PDPs can be classified into Direct Current (DC) PDPs, Alternating Current (AC) PDPs, and hybrid PDPs according to their driving method. In addition, PDPs can be classified into opposing discharge PDPs and surface discharge PDPs according to their discharge structure. Most PDPs produced recently have been three-electrode surface discharge PDPs.

A three-electrode surface discharge PDP includes an upper substrate and a lower substrate facing the upper substrate. Sustain electrode pairs are disposed on a lower surface of the upper substrate, and an upper dielectric layer embedding the sustain electrode pairs and a protective layer covering the upper dielectric layer are formed sequentially thereon. Each of the sustain electrode pairs includes a scan electrode and a common electrode. In addition, the scan electrode and the common electrode respectively include transparent electrodes and bus electrodes.

Address electrodes extending perpendicularly to the sustain electrode pairs and a lower dielectric layer embedding the address electrodes are formed on an upper surface of the lower substrate. Barrier ribs are formed on the lower dielectric layer to define a plurality of discharge cells. The barrier ribs extend in two directions crossing each other in a matrix pattern. A phosphor layer is formed on the barrier ribs and on the lower dielectric layer, and a discharge gas is contained within the discharge cells.

In the PDP having the above structure, a plasma is formed by a discharge caused by the sustain electrode pairs, and the phosphor layer is excited by vacuum ultraviolet rays emitted from the plasma. Then, visible light is emitted by the phosphor layer to display image.

However, in such a three-electrode surface discharge PDP, about 40% of the emitted visible light is absorbed by the sustain electrode pairs, the upper dielectric layer, and the protective layer formed under the upper substrate while the remaining visible light pass through those layers. Therefore, the light emission efficiency is low. In addition, if the same image is displayed for a long time, charged particles of the discharge gas may collide with the phosphor layer, thus causing a permanent residual image.

When forming the PDP, the upper portion of the PDP including the upper substrate and the lower portion of the PDP including the lower substrate are sealed, and an air exhausting process for discharging impure gas in the PDP and a filling process for filling a discharge gas in the discharge cells are performed. In the air exhausting process, a vacuum pump exhausts the gas from the PDP through an air exhaustion hole disposed in the lower substrate while the PDP is heated. If the exhaustion of the PDP is not performed sufficiently, the discharge gas to be filled in the panel later and the impure gas remaining in the panel mix, and the composition of the discharge gas is changed, and accordingly, a display operation becomes unstable. Since the discharge cells are sealed by the barrier ribs, sufficient air ventilation is interrupted, and thus, it takes a long time to exhaust the impure gas and fill the discharge gas. In addition, the impurities remain in the discharge cells that are located far from the ventilation hole. Especially in PDPs with super-fine and high resolutions, the inner structure of the panel is fine, and thus, difficulties with the exhaustion of the impure gas must be solved.

SUMMARY OF THE INVENTION

The present invention provides a PDP having good light emission efficiency and driving efficiency, and little phosphor material degradation.

The present invention also provides a PDP having an improved structure, in which flow resistance is reduced so that exhaustion of an impure gas and filling of a discharge gas can be performed rapidly.

According to an aspect of the present invention, a Plasma Display Panel (PDP) is provided comprising: an upper substrate: a lower substrate facing the upper substrate; upper barrier ribs arranged between the upper and lower substrates to define a plurality of discharge cells together with the upper substrate; discharge electrodes adapted to generate a discharge in the plurality of discharge cells; lower barrier ribs arranged between the upper barrier ribs and lower substrate along a row of the plurality of discharge cells to define a plurality of flow paths adapted to enable the plurality of discharge cells to communicate with each other; a phosphor layer arranged at a same level as the lower barrier ribs; and a discharge gas contained within the plurality of discharge cells.

The upper barrier ribs preferably extend in two directions crossing each other in a matrix pattern, and the lower barrier ribs are preferably arranged in a striped pattern extending along one of the two directions.

The upper barrier ribs preferably embed upper discharge electrodes and lower discharge electrodes separated from each other in a vertical direction and surrounding the plurality of discharge cells.

The upper and lower discharge electrodes preferably extend parallel to each other, each of the upper and lower discharge electrodes preferably surrounds a row of the plurality of discharge cells, and address electrodes preferably extend along the plurality of discharge cells and are arranged perpendicular to the upper and lower discharge electrodes.

The address electrodes are preferably arranged between the lower substrate and the phosphor layer, and a dielectric layer is preferably arranged between the phosphor layer and the address electrodes.

The lower barrier ribs preferably extend along a direction in which the address electrodes extend.

The lower barrier ribs preferably alternatively extend in a direction perpendicular to a direction in which the address electrodes extend.

The PDP preferably further comprises a protective layer adapted to cover side surfaces of the upper barrier ribs.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
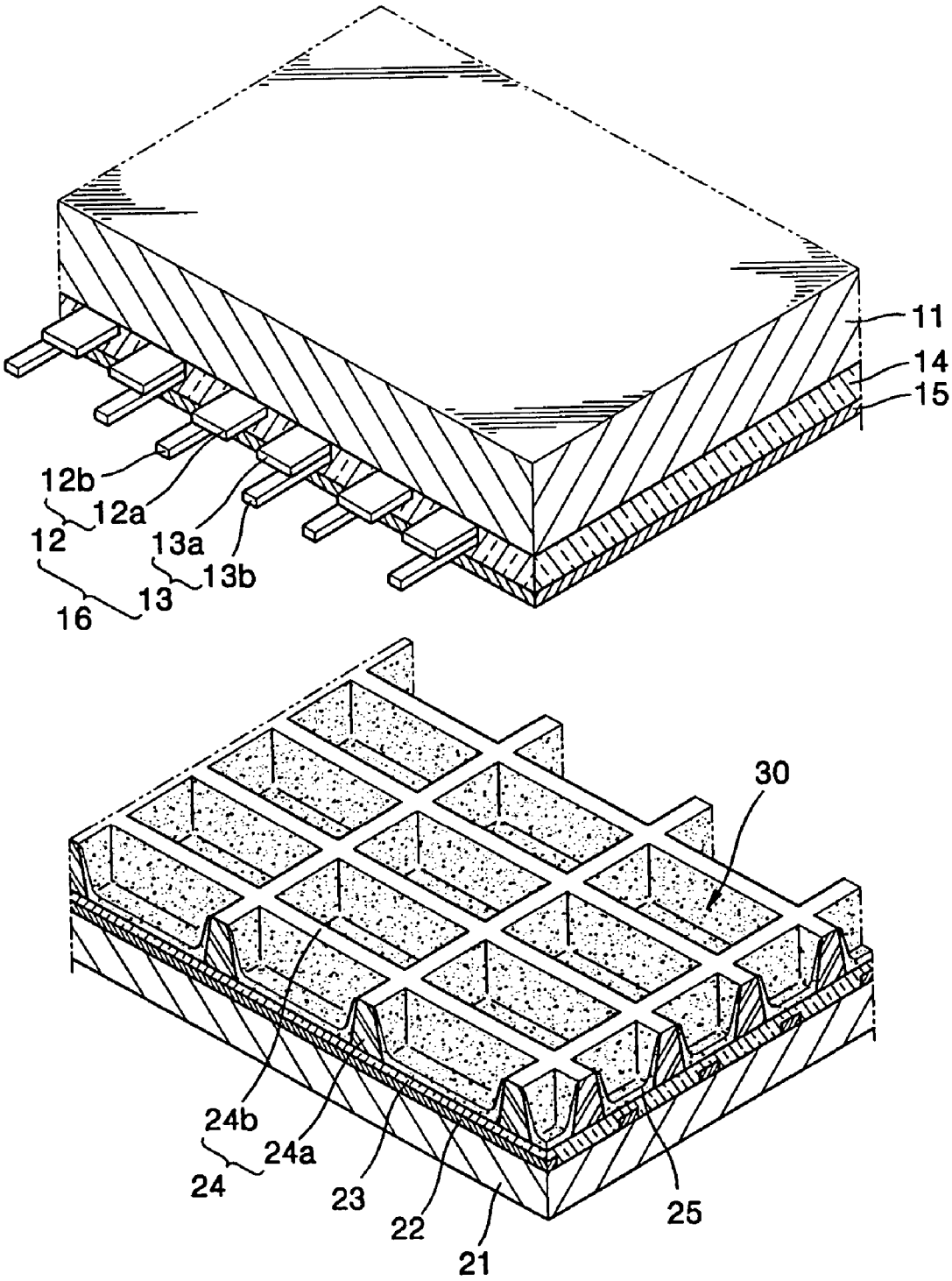
FIG. 1 is an exploded perspective view of a PDP.

FIG. 1 is a perspective view of a three-electrode surface discharge PDP. Referring to FIG. 1, the PDP includes an upper substrate 11 and a lower substrate 21 facing the upper substrate 11. Sustain electrode pairs 16 are disposed on a lower surface of the upper substrate 11, and an upper dielectric layer 14 embedding the sustain electrode pairs 16 and a protective layer 15 covering the upper dielectric layer 14 are formed sequentially thereon. Each of the sustain electrode pairs 16 includes a scan electrode 12 and a common electrode 13. In addition, the scan electrode 12 and the common electrode 13 respectively include transparent electrodes 12*a* and 13*a*, and bus electrodes 12*b* and 13*b*.

Address electrodes 22 extending perpendicularly to the sustain electrode pairs 16 and a lower dielectric layer 23 embedding the address electrodes 22 are formed on an upper surface of the lower substrate 21. Barrier ribs 24 are formed on the lower dielectric layer 23 to define a plurality of discharge cells 30. The barrier ribs 24 extend in two directions crossing each other in a matrix pattern. A phosphor layer 25 is formed on the barrier ribs 24 and on the lower dielectric layer 23, and a discharge gas is contained within the discharge cells 30.

In the PDP having the above structure, a plasma is formed by a discharge caused by the sustain electrode pairs 16, and the phosphor layer 25 is excited by vacuum ultraviolet rays emitted from the plasma. Then, visible light is emitted by the phosphor layer 25 to display image.

However, in such a three-electrode surface discharge PDP, about 40% of the emitted visible light is absorbed by the sustain electrode pairs 16, the upper dielectric layer 14, and the protective layer formed under the upper substrate 11 while the remaining visible light pass through those layers. Therefore, the light emission efficiency is low. In addition, if the same image is displayed for a long time, charged particles of the discharge gas may collide with the phosphor layer 25, thus causing a permanent residual image.

When forming the PDP, the upper portion of the PDP including the upper substrate 11 and the lower portion of the PDP including the lower substrate 21 are sealed, and an air exhausting process for discharging impure gas in the PDP and a filling process for filling a discharge gas in the discharge cells are performed. In the air exhausting process, a vacuum pump exhausts the gas from the PDP through an air exhaustion hole (not shown) disposed in the lower substrate while the PDP is heated. If the exhaustion of the PDP is not performed sufficiently, the discharge gas to be filled in the panel later and the impure gas remaining in the panel mix, and the composition of the discharge gas is changed, and accordingly, a display operation becomes unstable. Referring to FIG. 1, since the discharge cells 30 are sealed by the barrier ribs 24, sufficient air ventilation is interrupted, and thus, it takes a long time to exhaust the impure gas and fill the discharge gas. In addition, the impurities remain in the discharge cells 30 that are located far from the ventilation hole. Especially in a PDP with a super-fine and high resolution, the inner structure of the panel is fine, and thus, difficulties with the exhaustion of the impure gas must be solved.

Figure 2:
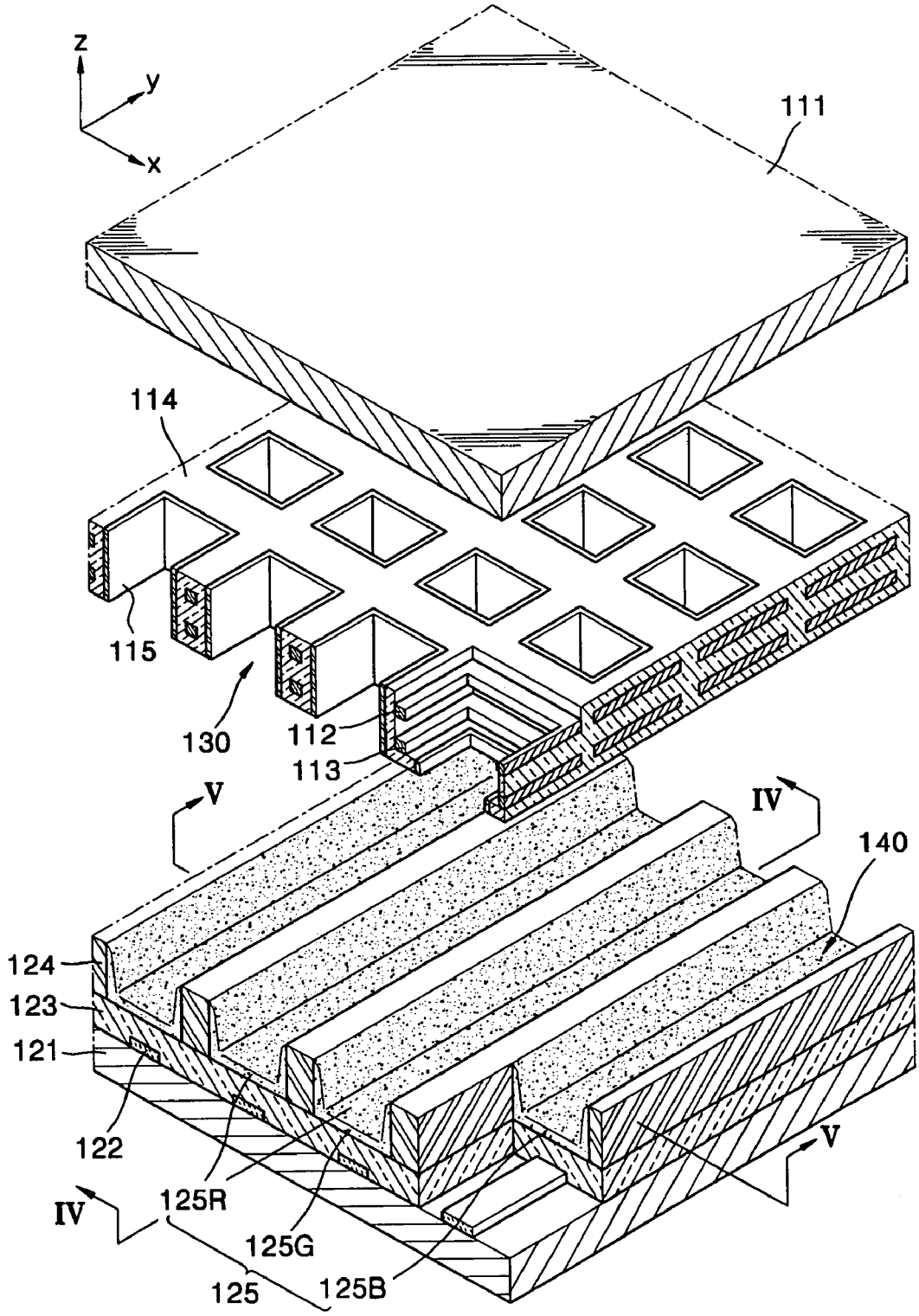
FIG. 2 is an exploded perspective view of a PDP according to an embodiment of the present invention.
Figure 3:
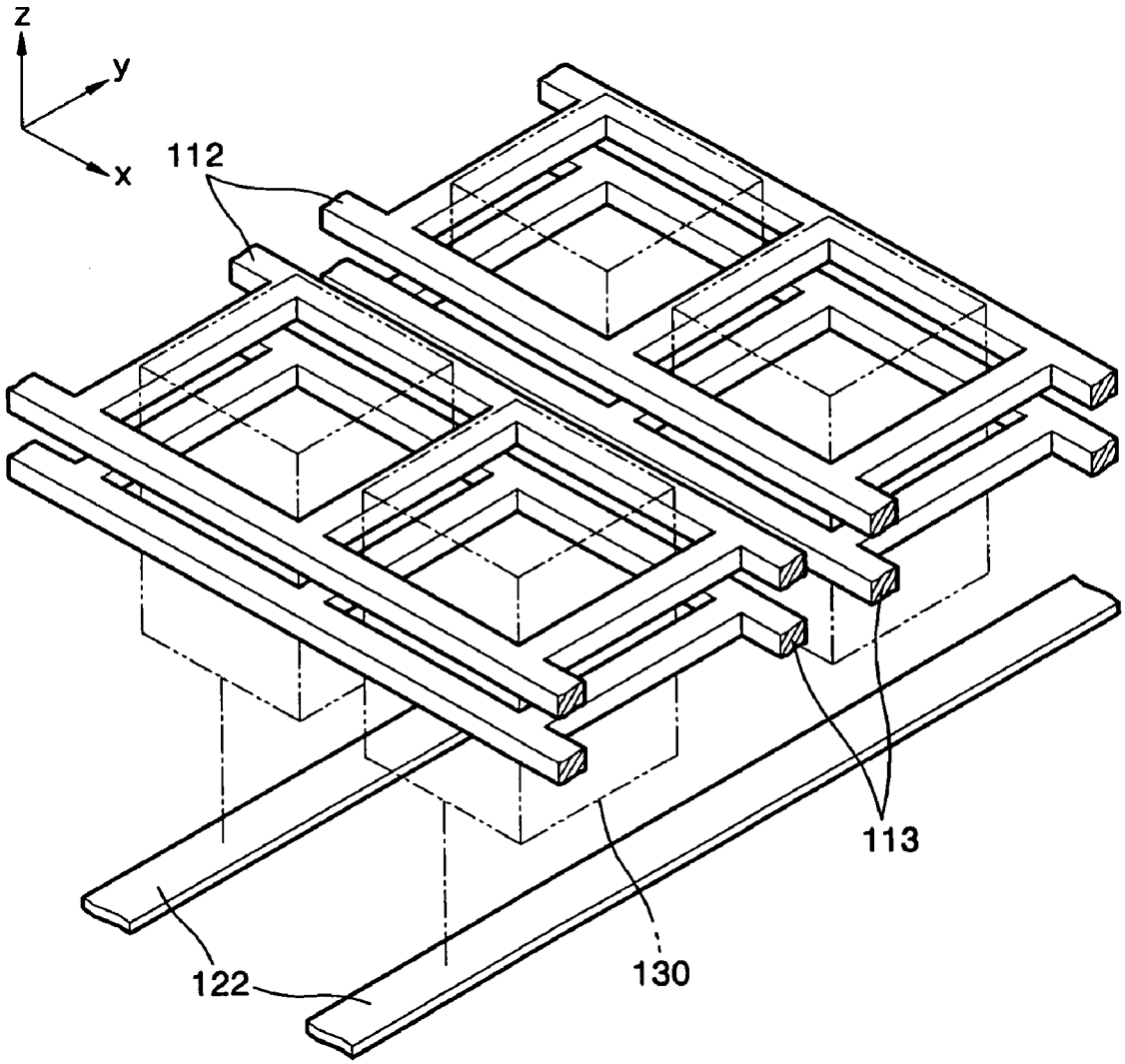
FIG. 3 is a perspective view of an electrode structure in the PDP of FIG. 2.
Figure 4:
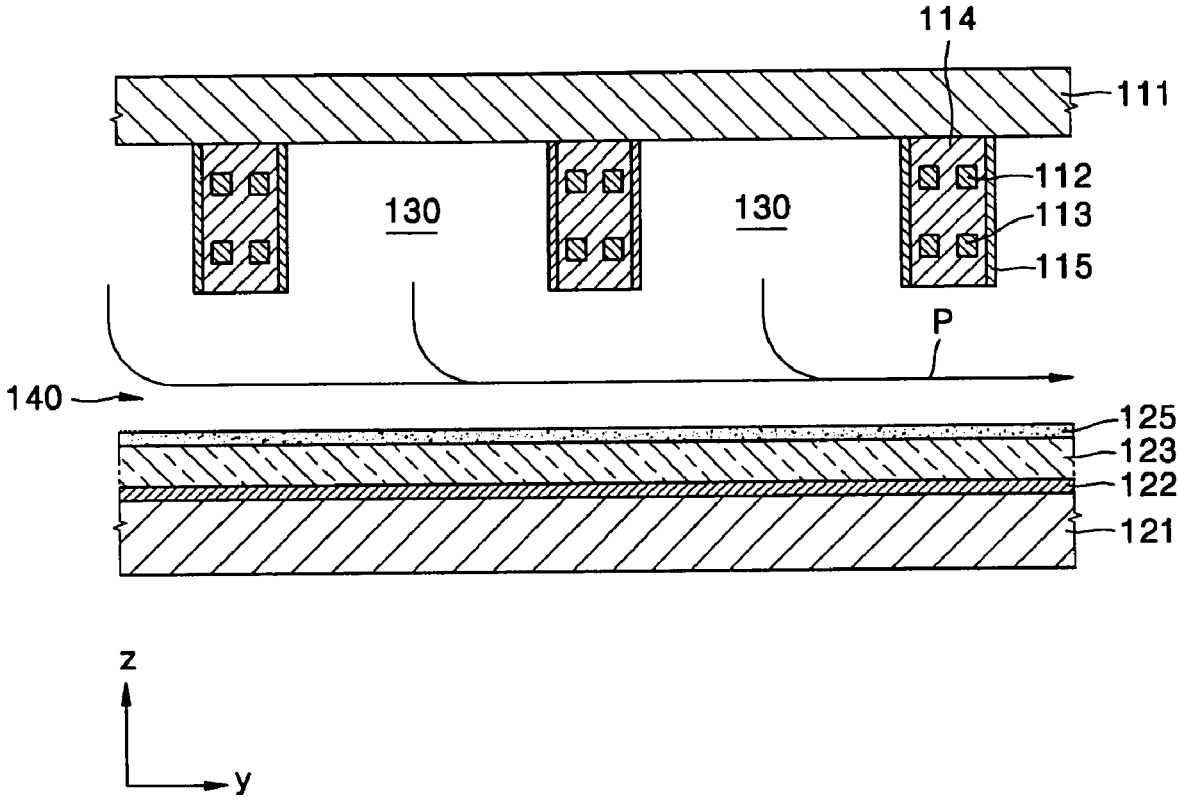
FIGS. 4 and 5 are cross-sectional views of the PDP taken along line IV-IV and line V-V of FIG. 2.
Figure 5:
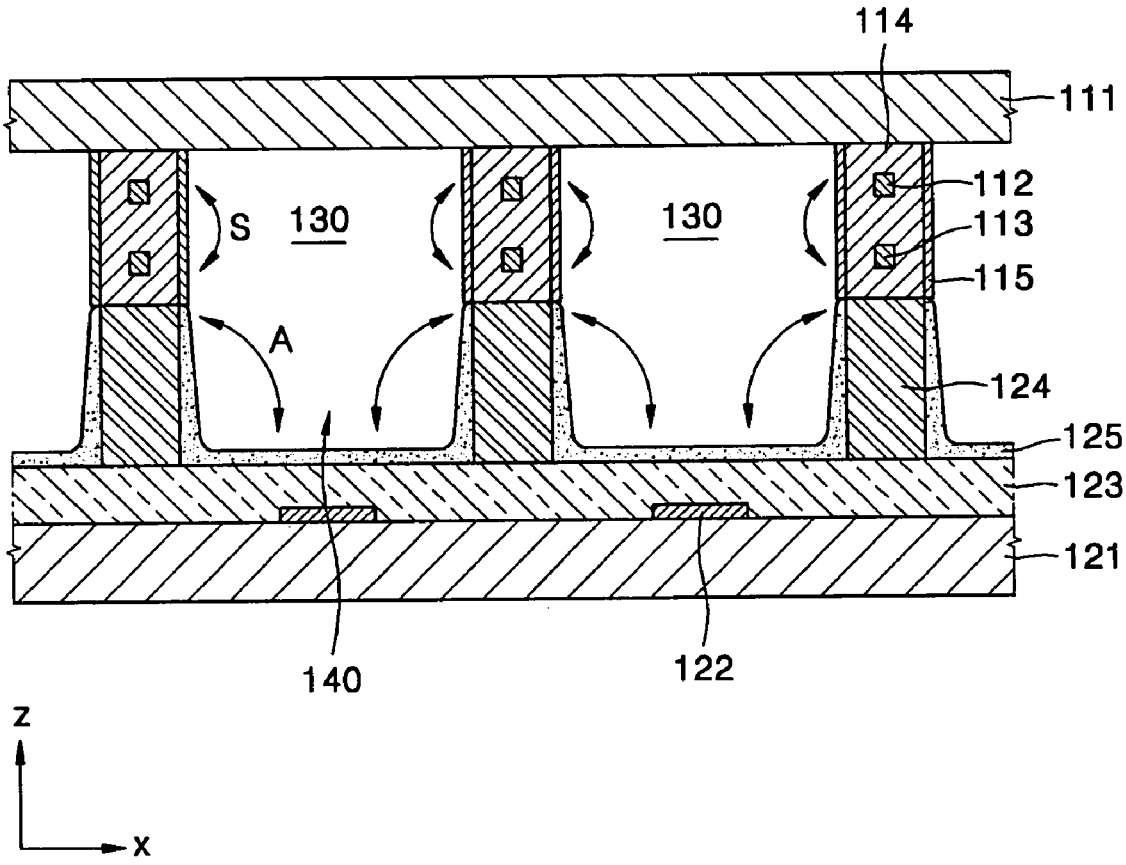

FIG. 2 is an exploded perspective view of a PDP according to an embodiment of the present invention, FIG. 3 is a perspective view of an electrode structure in the PDP of FIG. 2, and FIGS. 4 and 5 are cross-sectional views of the PDP taken along line IV-IV and line V-V of FIG. 2.

Referring to FIG. 2, the PDP according to the present embodiment includes an upper substrate 111 and a lower substrate 121 facing the upper substrate 111. The upper and lower substrates 111 and 121 are formed of a material including mainly glass, and in particular, when the upper substrate 111 displays an image, it is desirable for the upper substrate 111 to be formed of a material having a high light transmittance.

Upper barrier ribs 114 are formed under the upper substrate 111, and the upper barrier ribs 114 define discharge cells 130 with the upper substrate 111 to prevent cross talk from occurring between the discharge cells 130. Each of the discharge cells 130 is a Red sub-pixel, Green sub-pixel, or Blue sub-pixel of a pixel.

The upper barrier ribs 114 can be formed in a matrix pattern by extending in the x and y directions. The arrangement of the upper barrier ribs 1114 is not limited to the matrix pattern and can have a waffle or delta structure. The upper barrier ribs 114 are formed of a dielectric material to prevent upper discharge electrodes 112 and lower discharge electrodes 113 from electrically contacting each other, and induce wall charges to accumulate. The dielectric material forming the upper barrier ribs 114 can be PbO, $B_2O_3$, or $SiO_2$.

It is desirable that a protective layer 115 covers side surfaces of the upper barrier ribs 1114 to prevent charged particles from colliding with and causing damage to the upper barrier ribs 114, and to emit a large number of secondary electrons. The protective layer 115 can be composed of MgO.

The upper discharge electrodes 112 and the lower discharge electrodes 113 are embedded in the upper barrier ribs 114. The upper and lower discharge electrodes 112 and 113 are separated in the z-direction. The discharge electrodes 112 and 113 effect a sustain discharge to display the image. Referring to FIG. 3, the upper and lower discharge electrodes 112 and 113 are disposed parallel to each other, and are formed as ladders, which surround four sides of each of the discharge cells 130, extending in the x direction. One of the upper and lower discharge electrodes 112 and 113 functions as a scan electrode and the other functions as a common electrode. If the scan electrodes are disposed adjacent to address electrodes 122, the scan electrodes can lower the address voltage, and thus, it is desirable for the lower discharge electrodes 113 adjacent to the address electrodes 122 to function as the scan electrode.

The upper and lower discharge electrodes 112 and 113 are formed of a metal having a high electrical conductivity, for example, Ag, Cu, or Al. Therefore, the voltage drop caused by the resistance of the upper and lower discharge electrodes themselves can be minimized, and thus, driving efficiency and response speed can be improved, and a uniform voltage can be supplied to the discharge cells disposed far from the point where the voltage is supplied.

In addition, referring to FIG. 2, the address electrodes 122 are disposed on the lower substrate 121. The address electrodes 122 extend in a direction (y direction) perpendicular to the direction (x direction) in which the discharge electrodes 112 and 113 extend, and can be formed in a striped pattern. The address electrodes 122 generate an address discharge to form the sustain discharge between the upper and lower discharge electrodes 112 and 113, and thus, lower the initial voltage at which the sustain discharge starts. The address discharge occurs between the scan electrode and the address electrode 122, and when the address discharge is terminated, positive ions are accumulated at the scan electrode side of the corresponding discharge cell 130, and electrons are accumulated at the common electrode side of the corresponding discharge cell 130. Therefore, the sustain discharge between the scan electrode and the common electrode can be effected easily. However, the address electrodes 122 are not essential in the present invention, and if the address electrodes 122 are not formed, the upper and lower discharge electrodes can extend perpendicular to each other.

The address electrodes 122 are embedded in a dielectric layer 123. The dielectric layer 123 prevents the charged particles of the discharge gas from directly colliding with and damaging the address electrodes 122, and induces the wall charges. The dielectric layer 123 is formed of a dielectric material, for example, PbO, $B_2O_3$, or $SiO_2$.

Lower barrier ribs 124 with an open structure are formed on the dielectric layer 123. The lower barrier ribs 124 are formed in a striped pattern extending in one of the x and y directions, and in FIG. 2, the lower barrier ribs 124 extend in the y direction, along a row of the discharge cells 130. A space between the upper barrier ribs 114 and the lower substrates 121 is divided into a plurality of flow paths 140 by the lower barrier ribs 124, and each of the flow paths 140 allows a row of the discharge cells 130 to communicate with each other to reduce flow resistance when an impure gas is exhausted or a discharge gas is filled. That is, after sealing the PDP, the impure gas in the discharge cells 130 is exhausted using a vacuum pump, and the discharge cells 130 arranged in a row communicate with each other via the flow paths 140 as shown in FIG. 4, and thus, the impure gas in the discharge cells 130 flows along the flow paths 140 and is exhausted to the outside through a ventilation hole (not shown) formed on a bottom surface of the lower substrate 121. Reference designation P of FIG. 4 denotes a flow path of the impure gas.

In addition, after performing the air exhaustion process, the discharge gas, in which Ne and Xe are mixed, is injected into the panel using a gas injection device (not shown), and the discharge gas injected through the ventilation hole flows into the discharge cells 130 through the flow paths 140 formed along rows of the discharge cells 130. Therefore, the air exhaustion process or the filling process does not take an extended period of time, and accordingly, the fabrication costs of the PDP can be reduced.

In addition, if the lower barrier ribs 124 extend in the direction of the address electrodes 122 as shown in FIG. 2, the lower barrier ribs 124 can function as color mixture prevention ribs that prevent the colors of different phosphor materials 125R, 125G, and 125B from mixing with each other when applying phosphor material 125, and accordingly, the application of phosphor material 125 can be performed easily, and color purity can be maintained.

The phosphor material 125 is applied at the same level as the lower barrier ribs 124, that is, the phosphor material is disposed at the same height as the lower barrier ribs 124. In more detail, the phosphor material 125 is applied on the dielectric layer 123 and the sides of the lower barrier ribs 124, and referring to FIG. 2, the red phosphor material 125R, the green phosphor material 125G, and the blue phosphor material 125B are alternately applied to the spaces formed by the lower barrier ribs. The phosphor material 125 includes a component that receives ultraviolet light rays generated by the discharge gas and converts the ultraviolet light rays into visible light. The red phosphor material 125R can include $Y(V,P)O_4$:Eu, the green phosphor material 125G can include $Zn_2SiO_4$:Mn or $YBO_3$:Tb, and the blue phosphor material can include BAM:Eu. The discharge cells 130 are divided into red sub-pixels, green sub-pixels, and blue sub-pixels according to the wavelengths of visible light emitted by them. A row of discharge cells 130 where the red phosphor material 125R is applied are the red sub-pixels, a row of the discharge cells 130 where the green phosphor material 125G is applied are the green sub-pixels, and a row of the discharge cells 130, where the blue phosphor material 125B is applied are the blue sub-pixels. Although it is not shown in the drawings, the discharge gas, in which Ne and Xe are mixed, is contained within the discharge cells 130.

Referring to FIG. 5, in the PDP according to the present embodiment, the address voltage is supplied between the address electrodes 122 and the lower discharge electrodes 113 to generate a address discharge A, and as a result of the address discharge A, one of the discharge cells 130 where a sustain discharge S will occur is selected. After that, an Alternating Current (AC) at a sustain discharge voltage is supplied between the upper and lower discharge electrodes 112 and 113 in the selected discharge cell 130, and the sustain discharge S occurs between the upper and lower discharge electrodes 112 and 113. The discharge gas is excited by the sustain discharge S, and the energy level of the excited discharge gas is lowered to emit the ultraviolet light rays. The ultraviolet light rays excite the phosphor material 125 in the selected discharge cell 130, and then the energy level of the phosphor material 125 is lowered and visible light is emitted. The emitted visible light is used to display the image.

On the upper substrate 1111 in the PDP according to the present embodiment, the discharge sustain electrode pairs 16 and the dielectric layer 14 covering the discharge sustain electrode pairs 16 that are disposed on the upper substrate 111 of a conventional PDP of do not exist. Therefore, the visible light emitted from the phosphor material 125 is not blocked, and the upward transmittance of the visible light is greatly improved. In addition, the PDP can be driven with a lower voltage than a conventional PDP, and thus, the light emission efficiency is improved.

In addition, in the PDP of the present embodiment, since the sustain discharge S occurs only in the region defined by the upper barrier ribs 114, ion sputtering of the phosphor material caused by the charged particles is prevented, and accordingly, a permanent residual image is not generated even when the same image is displayed on the screen for a long time.

Figure 6:
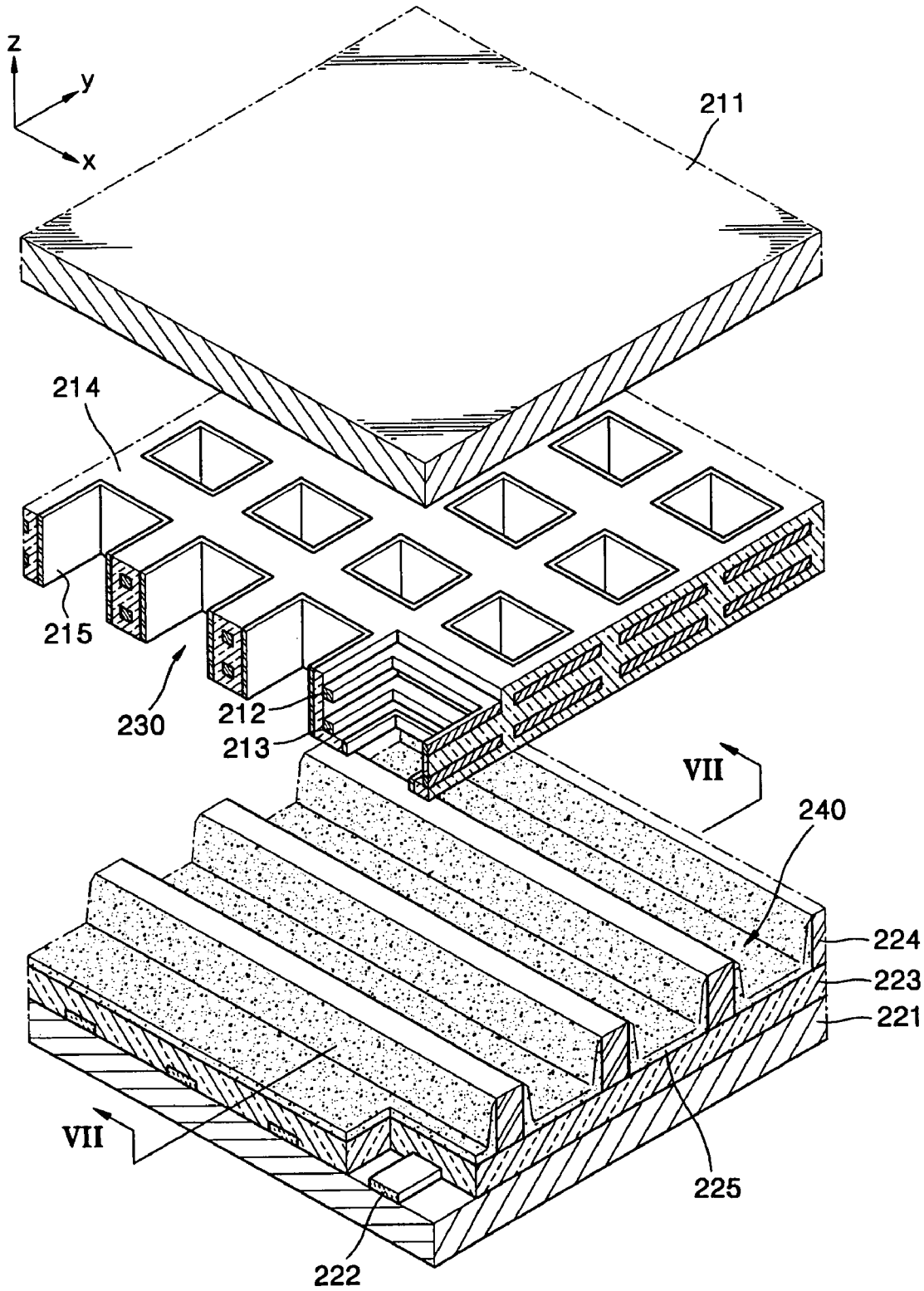
FIG. 6 is an exploded perspective view of a PDP according to another embodiment of the present invention.
Figure 7:
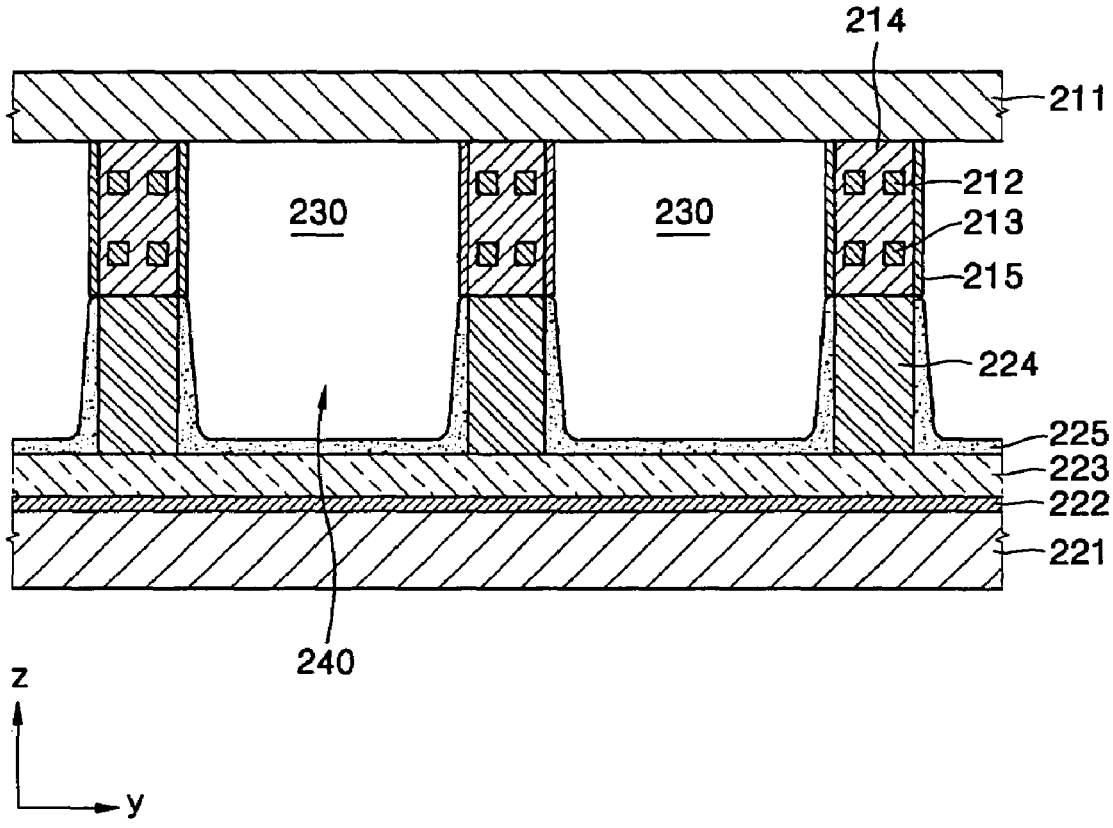
FIG. 7 is a cross-sectional view of the PDP taken along line VII-VII of FIG. 6.

FIG. 6 is an exploded perspective view of a PDP according to another embodiment of the present invention, and FIG. 7 is a cross-sectional view of the PDP taken along line VII-VII of FIG. 6. The PDP includes an upper substrate 211 and a lower substrate 221 facing the upper substrate 211, and barrier ribs 214 formed between the upper and lower substrates 211 and 221 to define a plurality of discharge cells 230. In addition, lower barrier ribs 224 are formed between the upper barrier ribs 214 and the lower substrate 211, and the lower barrier ribs 224 extend in a predetermined direction (x direction) to define flow paths 240 through which a row of the discharge cells 230 communicate with each other. The lower barrier ribs 224 of the present embodiment extend in the direction (x direction) perpendicular to the extending direction (y direction) in which the address electrodes 222 extend, and thus, the lower barrier ribs 224 can reduce the flow resistance of an impure gas and a discharge gas and prevent cross-talk from occurring between the discharge cells due to the charged particles moving along the address electrodes 222. That is, conventionally, when the charged particles contributing to the discharge are induced into the adjacent discharge cells 230 along the address electrodes 220, a defective discharge, for example, the wrong discharge performing the discharge operation regardless of the scan signal or an over-discharge resulting in a discharge smear can be generated. However, in the present embodiment, the lower barrier ribs 224 extend perpendicularly to the address electrodes 222, and thus, the movement of the charged particles along the address electrodes 222 is substantially prevented.

The discharge electrodes including the upper and lower discharge electrodes 1112 and 113, a protective layer 215, a phosphor material 225, a dielectric layer 223, and the address electrodes are the same as those of the previous embodiment.

In the drawing figures of the present invention, the upper and lower discharge electrodes surround the discharge cells arranged along a row extending in the direction in which upper and lower discharge electrodes extend. However, another structure of the discharge electrodes can be applied to the present invention; for example, the upper and lower discharge electrodes can extend in a striped pattern while crossing side portions of the discharge cells arranged in a row. If the upper and lower discharge electrodes are extended while crossing the side portions of the discharge cells that are arranged in two directions perpendicular to each other, additional address electrodes are not required.

According to the present invention, the flow paths of the PDP are formed for communication between the discharge cells arranged in a row, and the facilitation of the exhaustion of the impure gas and the filling of the discharge gas. Accordingly, the manufacturing time can be reduced and productivity yield can be improved.

In addition, the impure gas can be exhausted to the outside through the flow paths, and thus, a change in the composition of the discharge gas due to the remaining impure gas can be prevented, and the image display can be performed stably.

Furthermore, the brightness level and the light emission efficiency are higher than those of a conventional three-electrode surface discharge PDP, and a degrading of the phosphor material can be avoided.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP) comprising:

an upper substrate:

a lower substrate facing the upper substrate;

upper barrier ribs arranged between the upper and lower substrates to define a plurality of discharge cells together with the upper substrate;

discharge electrodes adapted to generate a discharge in the plurality of discharge cells;

lower barrier ribs arranged between the upper barrier ribs and lower substrate along a row of the plurality of discharge cells to define a plurality of flow paths adapted to enable the plurality of discharge cells to communicate with each other;

a phosphor layer arranged at a same level as the lower barrier ribs; and a discharge gas contained within the plurality of discharge cells.

2. The PDP of claim 1, wherein the upper barrier ribs extend in two directions crossing each other in a matrix pattern, and wherein the lower barrier ribs are arranged in a striped pattern extending along one of the two directions.

3. The PDP of claim 1, wherein the upper barrier ribs embed upper discharge electrodes and lower discharge electrodes separated from each other in a vertical direction and surrounding the plurality of discharge cells.

4. The PDP of claim 3, wherein the upper and lower discharge electrodes extend parallel to each other, wherein each of the upper and lower discharge electrodes surrounds a row of the plurality of discharge cells, and wherein address electrodes extend along the plurality of discharge cells and are arranged perpendicular to the upper and lower discharge electrodes.

5. The PDP of claim 4, wherein the address electrodes are arranged between the lower substrate and the phosphor layer, and wherein a dielectric layer is arranged between the phosphor layer and the address electrodes.

6. The PDP of claim 4, wherein the lower barrier ribs extend along a direction in which the address electrodes extend.

7. The PDP of claim 4, wherein the lower barrier ribs extend in a direction perpendicular to a direction in which the address electrodes extend.

8. The PDP of claim 1, further comprising a protective layer adapted to cover side surfaces of the upper barrier ribs.

* * * * *